US005197729A

United States Patent [19]

Couper

[11] Patent Number: 5,197,729

[45] Date of Patent: Mar. 30, 1993

[54] DOCUMENT TRANSPORT TRACK DRIVE MECHANISM

[75] Inventor: John Couper, Scotland, United Kingdom

[73] Assignee: Unisys Corporation, Blue Bell, Pa.

[21] Appl. No.: 792,826

[22] Filed: Nov. 15, 1991

[30] Foreign Application Priority Data

Nov. 15, 1990 [GB] United Kingdom ..... 9024906

[51] Int. Cl.[5] ..... B65H 9/16

[52] U.S. Cl. ..... 271/248; 271/251; 198/790

[58] Field of Search ..... 271/248, 250, 251, 264, 271/272; 198/790, 624, 722

[56] References Cited

U.S. PATENT DOCUMENTS

| | | | |
|---|---|---|---|
| 1,898,005 | 2/1933 | Diescher | 271/251 X |
| 3,770,265 | 11/1973 | Gatti | 271/250 X |
| 4,111,412 | 9/1978 | Cathers | 271/251 |
| 4,214,745 | 7/1980 | Morgret | 271/272 |
| 4,275,809 | 6/1981 | Garvey et al. | 271/272 X |
| 4,355,715 | 10/1982 | Chorlton | 198/790 X |
| 4,372,442 | 2/1983 | Fleischauer | 198/790 |
| 4,588,073 | 5/1986 | Abell | 198/790 |
| 4,836,527 | 6/1989 | Wong | 271/251 |
| 4,900,007 | 2/1990 | Gämmerler | 271/272 X |

FOREIGN PATENT DOCUMENTS

| | | | |
|---|---|---|---|
| 18238 | 1/1990 | Japan | 271/264 |

OTHER PUBLICATIONS

Rogers, "Caster Drive and Aligning Mechanism"; Feb. 1974, IBM Tech. Disclosure Bulletin, vol. 16, No. 9, p. 2960.

*Primary Examiner*—Robert P. Olszewski
*Assistant Examiner*—Boris Milef
*Attorney, Agent, or Firm*—John B. Sowell; Mark T. Starr

[57] ABSTRACT

An improved document transport track drive system for a document processing machine for driving a document 10 along a track 12. The drive mechanism comprises a common drive motor 20 driving a drive shaft 30 arranged parallel to the plane of the documents in the transport track 12. Keyed to the drive shaft 30 are a number of drive pulleys 32 spaced apart and each driving, by way of a power take-off system, a document drive roller 16 mounted at right angles to the plane of the drive pulley 32. The power take-off system comprises a single drive belt 40 and a pair of idler pulleys mounted at right angles to the plane of the drive pulley 32 and arranged to turn the drive belt through 90°.

7 Claims, 3 Drawing Sheets

DOCUMENT TRANSPORT TRACK DRIVE MECHANISM

BACKGROUND OF THE INVENTION

1. Related Applications

This application is related to and claims the prior filing date of United Kingdom Application No. 90-24906.1 entitled "Document Transport Track Drive Mechanism" filed Nov. 15, 1990.

2. Field of the Invention

The present invention relates to a roller drive mechanism for use in document processing machines incorporating a document transport track.

3. Description of the Prior Art

Many different types of document transport machines exist for the automatic mechanical or electronic processing of documents. The automatic processing of documents involves the deposition of data thereon, the retrieval of data therefrom, and sorting and stacking the documents. Automatic document processing also involves in its broad scope computer punched cards and checks and includes all sorts of official and financial documents bearing indicia thereon. The present invention will be described with reference to its prefer use in a check encoding machine using the automatic processing of bankers checks. It is to be understood that this represents only one area of use of the present invention and that the present invention may be applied to other types of document transport equipment where a document is moved along a track in a manner to be disclosed hereinafter.

Heretofore, check encoding and transport equipment was available that accepted stacks of checks each of which is removed from the stack and moved along a document track to be processed and thereafter delivered and sorted to one of a plurality of output stacks The present invention concerns itself with the roller drive mechanism for the document track where the checks are transported in the course of being processed.

Document processing machines, for use in check handling and the like, drive the document to be processed along a horizontal transport track using a series of horizontal, or near horizontal, pairs of rollers spaced at intervals which are less than the minimum length of the document being transported. In check handling equipment a roller drive is required every four inches or so. Accordingly, in transport tracks of the order of several feet a substantial number of pairs of rollers is required.

Typically the rollers of a pair are arranged such that one roller is driven while the other roller idles by urges the document to be transported towards the driven roller.

The rollers of the track are driven from a drive motor or motors using a system of drive belts. The drive belts may be arranged in cascade fashion or on an individual basis involving intermediate pulleys.

Such systems of belt drives involve a substantial number of individual belts each of which are prone to breakage, stretch and wear, making the sorting equipment prone to major breakdown since a single belt failure may disrupt the entire document transport mechanism.

SUMMARY OF THE INVENTION

It is a primary object of the present invention to reduce the number of belts required in a roller drive mechanism for use in, for example, a document transport track and to minimize the effect of single belt failures.

It is another primary object of the present invention to provide a structure in which the drive belt is arranged such that replacement does not require the belt being replaced to be slipped along the length of the drive shaft.

It is another object of the invention to provide a document roller power take-off system which includes a further pair of idler pulleys located remote from the drive pulley and mounted in the same plane as the drive pulley and having their centers located at opposite sides of the center of the drive pulley in such manner that the drive belt co-operates with the drive pulley without enveloping the drive pulley.

It is another object of the present invention to mount the power take-off system as a single unit separable from its drive pulley.

It is a general object of the present invention to provide a drive belt that is non-flat such as an 'O' ring or a regular polygon in cross section to permit flexture in two-drive planes.

According to the present invention there is provided a roller drive system for use with a document transport track, the drive system comprising a common drive motor driving a drive shaft arranged parallel to the plane of transport of the transport track and having keyed thereto in spaced relationship a plurality of drive pulleys each driving a document drive roller power take-off system comprising a single document roller drive belt, a document drive roller having its axis located substantially at right angles to the plane of transport and a pair of idler pulleys located at right angles to the plane of the drive pulley and co-operating with the drive belt such that the plane of the drive belt is turned through at most 90° to co-operate with the document drive roller.

BRIEF DESCRIPTION OF THE DRAWINGS

The invention will be more readily understood from the following description of one exemplary embodiment thereof which should be read in conjunction with the accompanying drawings.

DETAILED DESCRIPTION OF THE PREFERRED EMBODIMENTS

Figure 1:
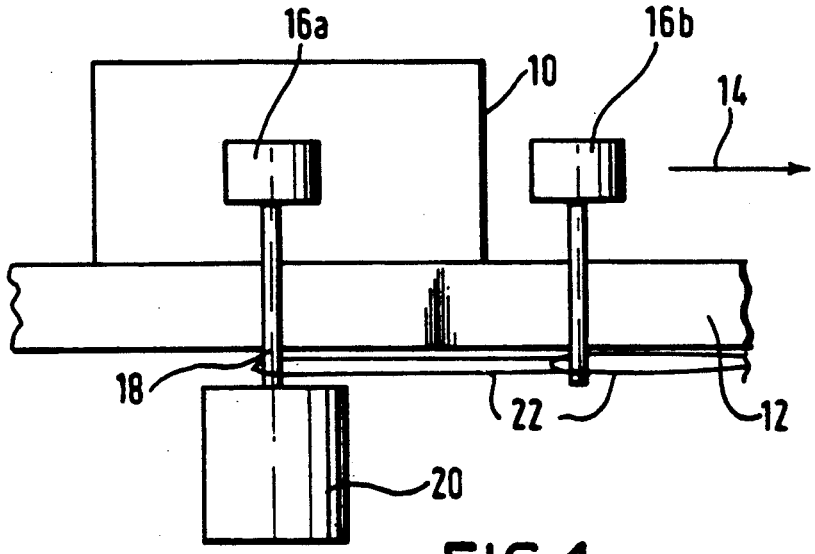
PRIOR ART FIG. 1.
FIG. 1 is a schematic drawing in front elevation of a document being transported along a prior art transport track.

Refer now to FIG. 1, showing a typical document transport track according to the prior art. A document 10 is transported along the document track 12 in the direction of the arrow 14 by a series of horizontally mounted drive rollers 16. The rollers 16 are spaced along the track at intervals which are less than the minimum length of the document 10 to be transported. Rollers 16 pinch document 10 between idle rollers (not shown) which are located on the back side of the document 10. Each roller 16 is driven by a motor 20, either directly by way of a direct drive shaft 18 or through a system of drive belts 22 coupled to shaft 18.

Figure 2:
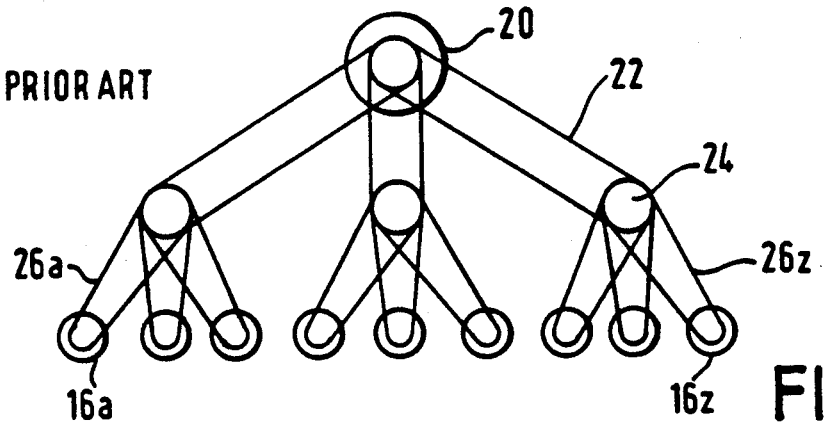
PRIOR ART FIG. 2.
FIG. 2 is a schematic drawing showing the layout of a distributed drive system for the prior art transport track.

FIG. 2 shows a prior art system of distributed drive belts involving intermediate pulleys 24 and primary belts 22 co-operating with secondary drive belts 26*a* to 26*z* driving the document rollers 16*a* to 16*z*.

Figure 3:
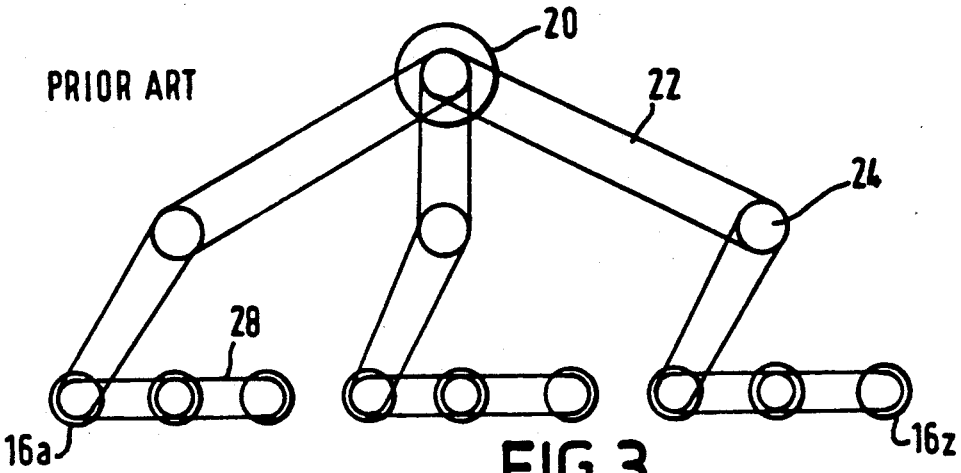
PRIOR ART FIG. 3.
FIG. 3 is a schematic drawing showing the layout of a composite distributed/cascade drive system for a prior art transport track.

FIG. 3 shows an alternative prior art system of cascaded secondary drive belts 28 driven from intermediate pulleys 24 and primary drive belts 22 which are driven from the drive motor 20.

In both these prior art systems the belts are prone to breakage, stretch and wear. A single belt failure may result in unserviceability of the entire document transport system. In addition it will be seen that five differing lengths of belts are required for the system shown. In the cascaded system, belt creep will contribute to decreasing roller speed at the remote end of the belt cascade.

Figure 4:
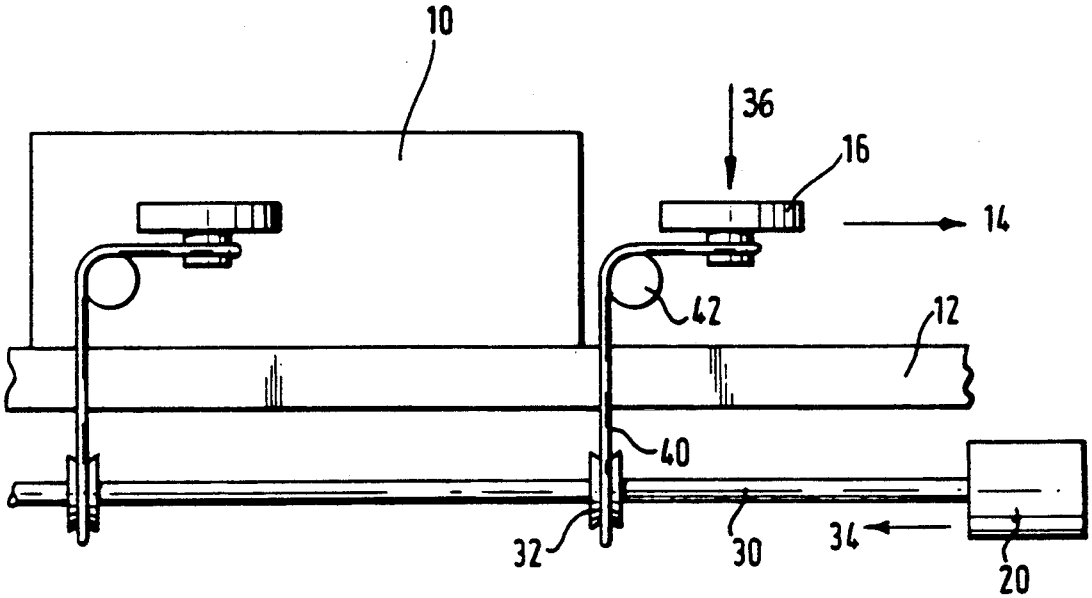
FIG. 4 is a schematic drawing in front elevation showing a document transport track using a document roller drive system according to one embodiment of the present invention.

FIG. 4 shows the configuration of a document transport track incorporating a roller drive system according to the present invention. Similar reference numerals have been used in FIG. 4 for equivalent components of FIGS. 1 to 3 The document 10 is transported along the document track 12 in the direction of the arrow 14 by the horizontally mounted rollers 16 in similar fashion to that of the prior art transport track, however, the drive motor 20 is mounted so that the rigid drive shaft 30 is parallel to the document track 12 and orthoganal to rollers 16. The drive shaft 30 runs the length of the track 12 providing a distributed drive throughout the machine. An incidental advantage of the drive mechanism according to FIG. 4 is that the overall height of the system is reduced.

Figure 5:
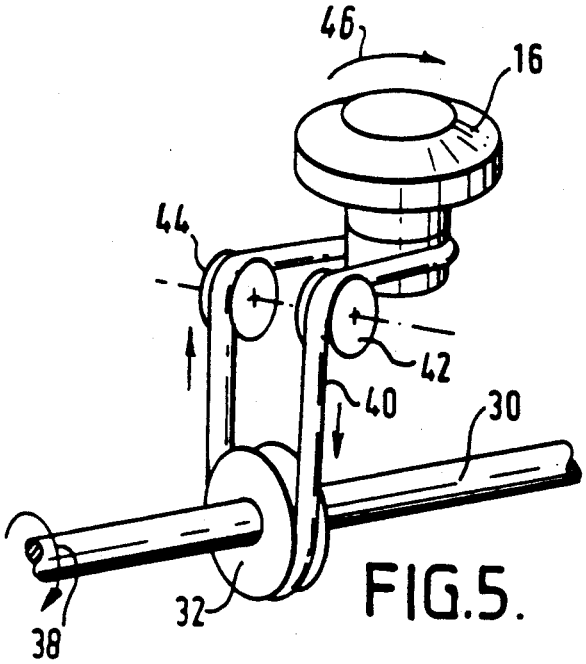
FIG. 5 is an isometric drawing of the document roller drive mechanism shown in FIG. 4.

Keyed or fixed to the drive shaft 30 are drive pulleys 32 each of which drive a document roller 16 by way of a belt drive power take-off system 40,42 shown in more detail in FIG. 5.

In operation the motor 20 rotates the drive shaft 30 in a counter clockwise direction, when looking from the motor 20 along the drive shaft 30, in the direction of arrow 34, which causes the rollers 16 to rotate in a clockwise manner when viewed from the direction of arrow 36.

A more detailed configuration of a document roller drive mechanism can be seen from isometric drawing FIG. 5. The arrow 38 shows the rotation of the drive shaft 30. Keyed to the drive shaft 30 is a pulley 32 which drives a power take-off system comprising an 'O' ring closed belt 40 and a pair of idler pulleys 42 and 44 and a roller pulley 16. The belt 40 drives the roller pulley 16 in the rotational direction identified by arrow 46. The idler pulleys 42 and 44 are preferably mounted at right angles to the plane of the drive pulley 32 and accordingly convert the rotary motion about a horizontal axis provided by the drive shaft 30 to a vertical axis required by roller 16 to drive the documents 10 along the document transport track in the direction 14.

It will be recognized that the roller drive mechanism of FIG. 5 uses a single belt of a standard size thereby reducing the initial cost of the belts as well as the system maintenance cost and down time The power take-off system of FIG. 5, however, has a belt replacement problem in that a replacement belt which encircles the shaft 30, pulley 32 and roller 16 will have to be fed from one end bypassing other drive mechanisms until the roller drive 16 requiring the replacement belt is reached. Belt replacement may be easily performed in that belt 40 is larger in diameter than prior art drive belts due to the 90° degree offset around pulley's 42,44. The present design permits the belt 40 to be such large diameter to permit the belt to be passed along shaft 30 over roller pulleys 16 or alternatively if a smaller diameter belt is employed the belt may be passed over or between pulley's 42,44 and between roller pulley 16 and pulley's 42,44 when the belts 40 that are not being replaced, are first loosened and then replaced on their pulleys. The present invention provides a belt which of such diameter to permit it to be passed around the roller drive mechanism, thus avoiding the problem in prior art. Long document transport track machines having a large number of roller drive mechanisms where belt replacement is difficult and time and time consuming.

Figure 6:
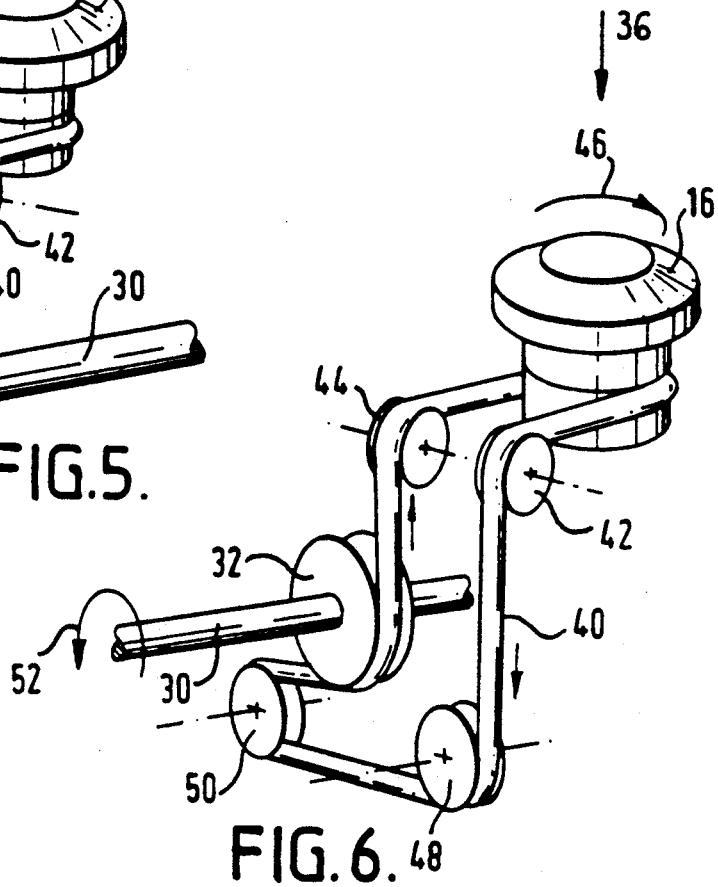
FIG. 6 is an isometric drawing of a document roller drive mechanism according to the preferred embodiment of the present invention.

To overcome this prior art difficulty a preferred embodiment of the present invention envisages a roller drive mechanism with an outboard power take-off system is shown in FIG. 6. Similar reference numerals have been used in FIG. 6 conforming to those used in FIG. 5 for the same components of the drive mechanism which perform the same functions. The advantage of the roller drive mechanism of FIG. 6 is that any drive belt 40 may be replaced without having to pass it along the length of the driveshaft of the machine. The mechanism of FIG. 6 includes an additional pair of idler pulleys 48 and 50 allowing the drive pulley 32 and shaft 30 to be placed outside or outboard of belt 40. The drive belt 40 no longer encircles or envelopes the drive shaft pulley 32 thereby allowing the belt to be replaced without it having to be slipped over the drive shaft 30. It should be noted that the drive shaft 30 requires that it be rotated in the opposite direction as represented by arrow 52, from that which is required in FIG. 5 as represented by arrow 38.

In a practical embodiment, not shown in the drawings, the roller drive power take-off system, comprising roller 16, idler pulleys 42, 44, 48 and 50 and the drive belt 40, form a removable unit mounted on a common block which may be removed from the document track 12 for belt renewal and other maintenance purposes without interference from the drive pulley 32.

Figure 7:
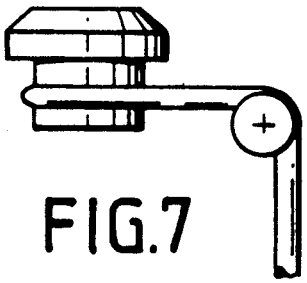
FIG. 7 is an end view showing a document roller mounted at right angles to the plane of the document transport track.
Figure 8:
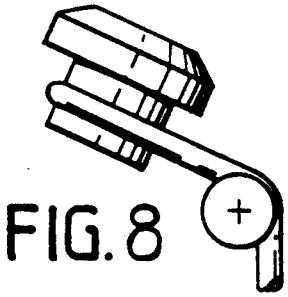
FIG. 8 is an end view showing a document roller mounted at an angle which is more than 90° to the plane of the document transport track.

Finally with reference to FIGS. 7 and 8 it will be seen that the roller 16 may be mounted to produce horizontal motion as shown in FIG. 7 or may be mounted at an angle to generate downward force on a document being transported as shown in FIG. 8. Clearly a roller configuration according to FIGS. 7 or 8 may be incorporated in the roller drive mechanisms according to the present invention.

The above description of two embodiments of a document roller drive mechanism both use an 'O' ring belt driven in orthogonal planes. Alternative uniform cross-sectional belt configurations such as a regular polygon could be employed as long as the belt may be conformed to two planes. This is particularly important in the case of the titled roller since there should be no twist on the belt which would lead to excessive belt wear.

While the invention has been described with respect to a document transport mechanism having a roller drive mechanism, the power take-off mechanism may be used for other devices and machines which require rollers to be driven at right angles to a common drive shaft.

What is claimed is:

1. A roller drive system for use in a document transport system for transporting a document along a transport track, said system having a common drive motor and a common drive shaft and comprising:

a plurality of drive pulleys mounted on said drive shaft in spaced relationship, said drive shaft being arranged in a plane parallel to the document plane of transport and said drive pulleys being rotatable in a plane orthogonal thereto, a document drive roller driven by a first drive pulley of said drive pulleys and rotatable in a plane orthogonal to the plane of rotation of said drive pulleys, a first idler pulley driven by said first drive pulley and rotatable in a plane orthogonal to the plane of rotation of said first drive pulley and said document drive roller, a second idler pulley driven by said first drive pulley and rotatable in a plane orthogonal to the plane of rotation of said first drive pulley and said document drive roller, and a flexible drive belt coupled to said first drive pulley in one plane and coupled to said document drive roller in a plane orthogonal thereto and directed over said first idler pulley and said second idler pulley to change the belt's plane of rotation on said first drive pulley substantially ninety degrees.

2. A roller drive system as set forth in claim 1 which further includes third and fourth idler pulleys located in the same plane as said first drive pulley and having an axis of rotation orthogonal to the axis of rotation of said first and said second idler pulleys.

3. A roller drive system as set forth in claim 2 wherein said flexible drive belt is arranged outboard of said drive shaft and said first drive pulley.

4. A roller drive system as set forth in claim 1 wherein said first idler pulley and said second idler pulley are axially aligned and there is further provided a second pair of idler pulleys located in the same plane with the first drive pulley on parallel axes of rotation and having their axes of rotation positioned on sides opposite said drive shaft axis.

5. A roller drive system as set forth in claim 4 wherein said idler pulleys and said document drive roller are mounted on a common base on said transport track.

6. A roller drive system as set forth in claim 5 wherein said flexible drive belt comprises an individual drive belt having a uniform geometric shape cross-section.

7. A roller drive system as set forth in claim 6 wherein said individual flexible drive belt comprises an 'O' ring belt.

* * * * *